United States Patent [19]

Duke

[11] Patent Number: 4,577,853

[45] Date of Patent: Mar. 25, 1986

[54] STACKING APPARATUS

[75] Inventor: B. Michael Duke, Plattsburgh, N.Y.

[73] Assignee: Harris Graphics Corporation, Melbourne, Fla.

[21] Appl. No.: 570,923

[22] Filed: Jan. 16, 1984

[51] Int. Cl.[4] ..... B65H 31/10

[52] U.S. Cl. ..... 271/217; 414/907; 271/220

[58] Field of Search ..... 271/217, 218, 220; 414/907

[56] References Cited

U.S. PATENT DOCUMENTS 3,825,134 7/1974 Stobb ..... 414/907 X
4,197,045 4/1980 Stauber ..... 414/907 X
4,311,090 1/1982 Dudziak ..... 414/907 X
4,311,475 1/1982 Imai ..... 414/907 X

FOREIGN PATENT DOCUMENTS 2080255 2/1982 United Kingdom ..... 414/907

*Primary Examiner*—Richard A. Schacher
*Attorney, Agent, or Firm*—Yount & Tarolli

[57] ABSTRACT

Apparatus for stacking sheetlike articles of flexible material includes a stack follower engaging the trailing end of a stack to prevent separation of articles from the stack adjacent its trailing end as the edges of the articles drag across a guide surface during lowering movement of the stack.

16 Claims, 9 Drawing Figures

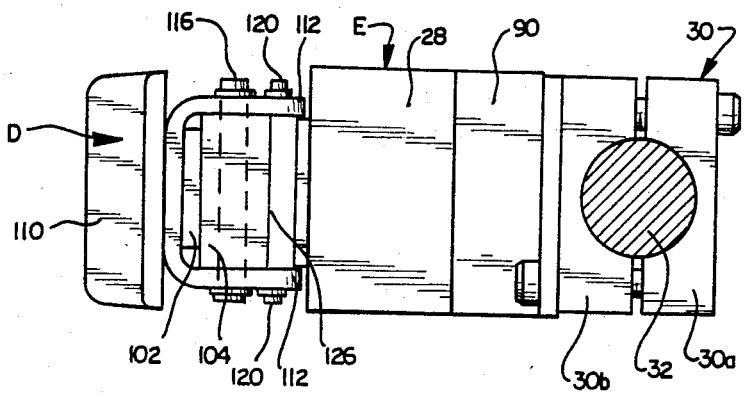
FIG.9
FIG.8
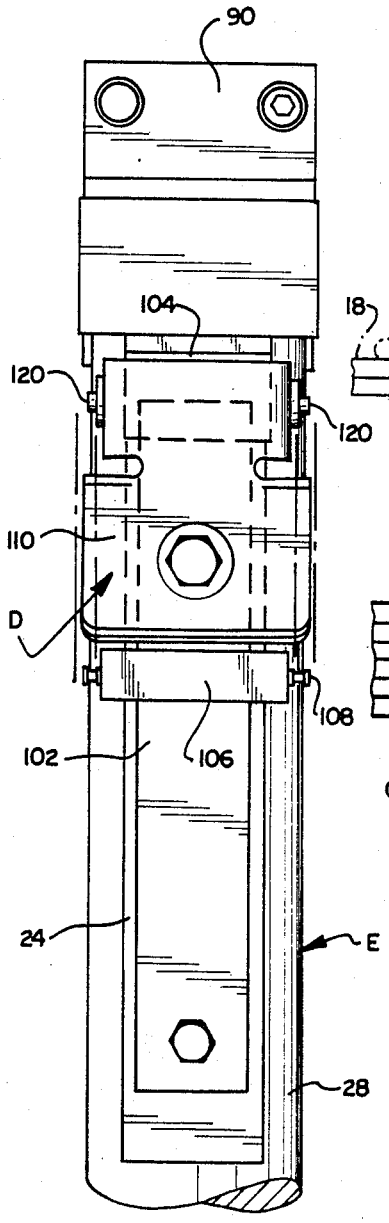
FIG.7
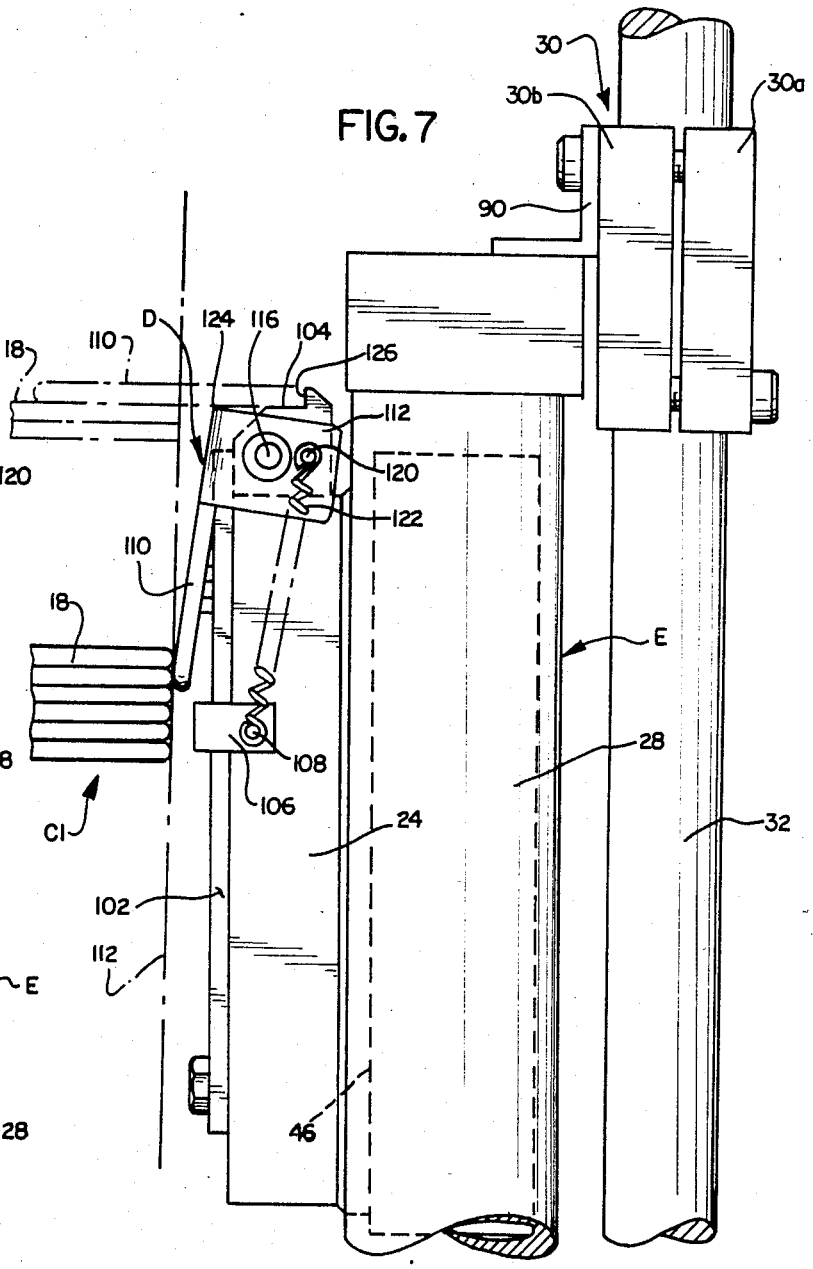

STACKING APPARATUS

BACKGROUND OF THE INVENTION

This application relates to the art of stacking and, more particularly, to stacking sheetlike articles of flexible material such as signatures from a printing press.

Signatures are commonly stacked on top of one another to form a stack in which the signatures are slightly inclined to the horizontal so that a rear face of the stack engages a guide surface. As the stack is lowered to a transfer position, the edges of the signatures at the rear face of the stack drag across the guide surface, and this tends to lift the signatures adjacent the trailing end of the stack and cause such signatures to lose their registration with the remainder of the signatures in the stack.

It would be desirable to have an arrangement for positively maintaining registration of all the signatures in a stack and preventing separation of the signatures from the stack adjacent its trailing end.

SUMMARY OF THE INVENTION

Apparatus comprising stacking means for stacking sheetlike articles into a stack and moving same to a stack transfer position during which an edge of the articles in the stack drag along a guide surface which causes separation of articles from the stack adjacent its trailing end. Follower means engages the trailing end of the stack to prevent separation of the articles and thereby maintain registration of all the articles in the stack.

The follower means is shiftable between stack-engaging and stack-clearing positions for allowing free movement of the follower means from the stack transfer position back to a ready position for engaging a new stack.

In its stack-engaging position, the follower means extends generally parallel to the stack and in its stack-engaging position extends generally parallel to the stack rear face.

The follower means is in the form of a hinged paddle for engaging the trailing end of a stack adjacent its rear face. The paddle is hinged for swinging movement between the stack-engaging and stack-clearing positions, and yieldable biasing means is provided for normally biasing the paddle to the stack-engaging position. Engagement of the paddle with a new stack being formed automatically moves the paddle to the stack-clearing position.

Linear actuator means is operable for moving the stack follower means and may take the form of a fluid cylinder.

BRIEF DESCRIPTION OF THE DRAWINGS

FIG. 7 is a partial side elevational view showing the follower means of the present application mounted on a fluid cylinder which in turn is guided on an elongated guide rod;

FIG. 8 is a front elevational view looking at FIG. 7 from the lefthand side thereof; and FIG. 9 is a top elevational view of FIG. 7.

DESCRIPTION OF A PREFERRED EMBODIMENT

Figure 1:
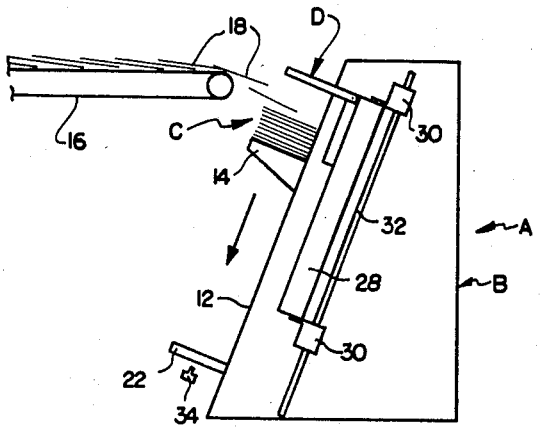
FIG. 1 is a schematic side elevational view of stacking apparatus having the follower means of the present application incorporated therein.

FIGS. 1–4 show stacking apparatus A including a supporting frame B having an elongatged front guide surface 12 which is inclined to the vertical at a relatively small angle, usually not more than 30°.

The stacking apparatus A includes stack support forks 14 having upper support surfaces extending generally perpendicular to the guide surface 12 and being movable downwardly generally parallel to the guide surface 12. Delivery conveyor means 16 carries overlapped sheetlike articles of flexible material, such as signatures from a printing press. These articles are referred to hereinbelow as sheets. The conveyor means 16 delivers same in succession one on top of the other in a stack C being formed on the support forks 14 which move downwardly at a controlled rate proportional to the arrival rate of the sheets 18 on the stack and the thickness thereof so that the top of the stack C remains at approximately the same elevation as it is being formed.

In the stacking apparatus of the type described, it is common to form successive stacks of the same height or the same number of sheets. This is accomplished in several different ways as by using a counting device to count the number of sheets delivered to a stack, or by sensing the height of the stack as by use of a photocell or limit switch. A gapper is then operated to create a gap in the stream of sheets 18 being supplied by the delivery conveyor 16 so there will be an interruption in the supply of sheets 18 between successive stacks.

When the gapper is operated to complete a stack and separate same from the next stack, the support forks 14 may also be given a signal to move downwardly at a faster rate for depositing the stack C at its transfer position on transer forks 22 from which the stack C is removed by a transfer device. During such downward movement of the stack C, its rear face is guided along the guide surface 12 and this causes a drag on the edges of the sheets 18 adjacent the rear face of the stack. This may cause the rear edge portions of the uppermost sheets 18 adjacent the trailing end of the stack to separate from the stack or lag behind the downward movement thereof. This may cause the sheets 18 adjacent the trailing end of the stack to lose registration with the other sheets in the stack. In order to prevent loss of registration of the sheets in the stack and to prevent separation of the sheets adjacent the trailing end of the stack, follower means D is provided for engaging the trailing end of the stack C and following same in engagement therewith to its transfer position on the transfer forks 22.

Figure 2:
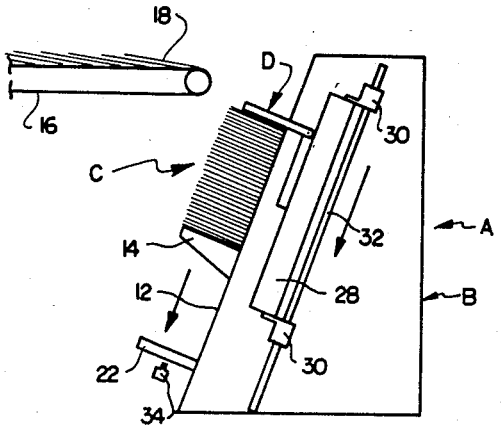
FIG. 2 is a view similar to FIG. 1 and showing the follower means in a different position.
Figure 3:
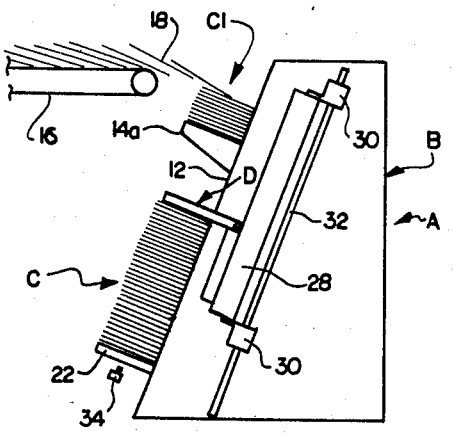
FIG. 3 is a view similar to FIGS. 1 and 2, and showing the follower means in a still different position.

FIG. 1 shows the follower means D parked in its uppermost ready position above the trailing end of the stack C being formed. Upon operation of the gapper to complete a stack C and begin formation of a new stack, the follower means D is also operated to move downwardly into engagement with the trailing end of the stack C as shown in FIG. 2. The velocity of the follower means D is substantially greater than the velocity of the support forks 14 so that the follower means D rapidly catches up with the stack C and engages the trailing end thereof during substantially all of its movement to the transfer position on the transfer forks 22. Obviously, there is a wide vertical slot in the guide surface 12 for accommodating the follower means D. Shortly after the follower means D moves into engagement with the trailing end of the stack C for movement therewith to the transfer position on the transfer forks 22, additional support forks 14*a* on the stacking apparatus A move into position to begin formation of a new stack C1 thereon. The new stack C1 is in the process of being formed as the stack C is moved to its transfer position on the transfer forks 22. When the stack C reaches its lowermost transfer position, the follower means D is operated to move back upwardly to the ready position shown in FIG. 1 for cooperation with the new stack C1 being formed. During upward movement of the follower means D past the new stack C1 being formed, the follower means D moves to a stack-clearing position shown in FIG. 4 to clear the new stack C1 and then park at the ready position of FIG. 1. This procedure continues in succession with each new stack having its trailing end engaged by the follower means D which then follows the stack to its transfer position whereupon the follower means D reverses direction and moves back to the ready position in preparation for cooperation with a new stack being formed.

Figure 4:
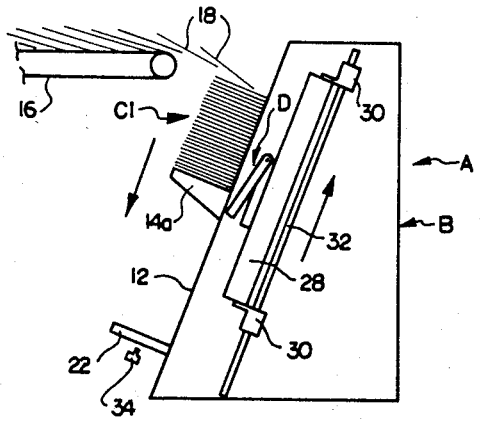
FIG. 4 is a view similar to FIGS. 1–3, and showing the follower means in a stack-clearing position for movement back to a ready position for cooperation with a new stack.

The follower means D is mounted on linear actuator means in the form of a fluid rodless cylinder 28 connected to a clamp 30 anchored on an elongated guide rod 32 extending generally parallel to the guide surface 12. When the follower means D reaches its lowermost position with the stack C at its transfer position on the transfer forks 22, the cylinder 28 is energized to reverse its direction of movement so that the follower means D begins moving upwardly as shown in FIG. 4 until the position of FIG. 1 is reached. At this point the cylinder piston is at the end of its stroke and fluid pressure will hold the follower means D parked at its ready position until it is again commanded to move downwardly when the gapper is operated.

In the arrangement shown and described, the individual sheets 18 in the stack C are inclined downwardly from the horizontal from left-to-right at a small angle, usually not more than 30°. The individual sheets 18 extend generally perpendicular to the guide surface 12. The follower means D extends generally parallel to the trailing end of the stack and generally perpendicular to the guide surface 12 in the ready position thereof and in its stack engaging position. The follower means D extends generally parallel to the rear face of the stack C and the guide surface 12 in the stack-clearing position thereof as shown in FIG. 4. Once the follower means D reaches the trailing end of a new stack C1 being formed in FIG. 4, the follower means D swings upwardly to its stack engaging position.

Figure 5:
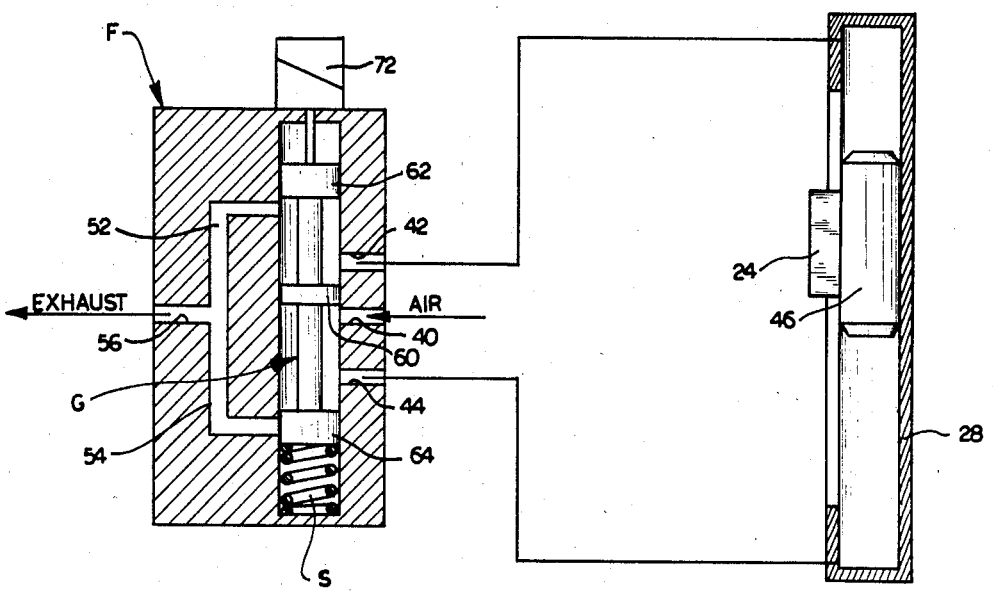
FIG. 5 is a schematic illustration of a valve and cylinder used with the apparatus of FIGS. 1–4.

FIG. 5 shows a solenoid operated directional control valve of the four-way, two position, spring return type. The valve F has an inlet port 40 for pressurized fluid, and control ports 42, 44 respectively connected with opposite ends of the cylinder 28 on opposite sides of a piston 46 therein connected with the piston lug 24. The exhaust ports 52, 54 communicate with a common exhaust port 56. A movable valve spool G has a central land 60, and opposite end lands 62, 64. The spool G is normally biased by a return spring S to the position shown wherein the central land 60 permits fluid pressure flow through supply port 40 and cylinder port 44, while land 60 permits exhaust flow through port 42 and 52, and land 64 blocks exhaust port 54. Solenoid 72 is provided for operating the spool G. The solenoid 72, may supply pilot pressure to the valve F for shifting the spool G or may be directly connected therewith for shifting same. When the solenoid 72 in FIG. 5 is energized, the spool G is shifted downwardly to open the ports 40, 42 to communicate with one another while leaving the exhaust port 52 blocked by the land 62, and to open communication between the port 44 and the exhaust port 54. Thus, fluid pressure supplied from the port 40 to the control port 42 and the top end of the cylinder 28 causes the piston 46 and lug 24 to move downwardly in FIG. 5 while the cylinder 28 below the piston 46 is open to exhaust through the control port 44 and the exhaust port 54. When the piston 46 and lug 24 reaches its lowermost position, which is controlled by the top of stack C, the solenoid 72 is deenergized, and the compressed springs biases the spool in an upward direction. This shifts the valve spool G upwardly in FIG. 5 to open the supply port 40 with the control port 44 while the land 64 blocks the exhaust port 54 and while the land 62 opens communication between the control port 42 and the exhaust port 52. This results in pressure fluid flowing from the supply port 40 to the control port 44 and into the cylinder 28 below the piston 46 so that the piston 46 moves upwardly in FIG. 5. Piston 46 will come to rest at the end of its stroke at the top of cylinder 28.

Figure 6:
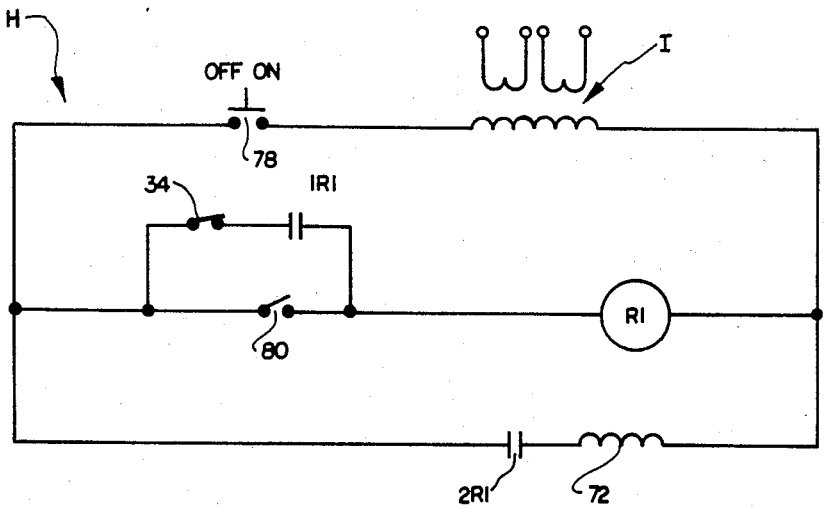
FIG. 6 is a schematic circuit diagram showing one arrangement for operating the valve in FIG. 5.

FIG. 6 shows a control circuit H to which current is supplied through a main off-on switch 78 from a transformer I. When the gapper is operated as by counting a predetermined number of sheets 18 moving past a certain point to be formed into a stack C, a normally open control switch 80 is momentarily closed to energize a relay R1 to close normally open relay contacts 1R1 and 2R1. Even though the momentary switch 80 opens, a holding circuit is established through the now closed contacts 1R1 to maintain the relay R1 energized. This also energizes the solenoid 72 through the now closed relay contacts 2R1 so that the valve F of FIG. 5 is operated as previously described to move the piston 46 downwardly and carry the follower means D therewith. When the piston 46 along with stack C reaches its lowermost position the support forks 14 engages and momentarily opens the limit switch 34, the relay R1 is deenergized. Thus, the solenoid 72 is deenergized, moving the piston 46 upwardly and carrying the follower means D therewith. Piston 46 remains in its uppermost position until the control switch 80 is again operated.

The linear actuator has been shown as a pneumatically operated cylinder and it will be recognized that it can also be hydraulically operated, or can be a mechanical linear actuator of the screw or inclined roller type. The diameter of the piston 46 is preferably small and the supply of fluid large so that very rapid movement of the follower means D is achieved when the control ports 42, 44 are open. It will be recognized that it is possible to provide pressure relief ports if so desired for limiting the amount of force exerted on the stack C by the follower means D. It is preferred to have a very high velocity for the follower means D while exerting a very small amount of yieldable force on the stack. This insures the desirable engagement of the follower means D with the trailing end of the stack while minimizing damaging forces on the support forks 14 and the mechanism in the stacking apparatus A which controls movement of same.

FIG. 7 shows segments 30*a*, 30*b* of the clamp 30 suitably clamped around the mounting rod 32. An angle bracket 90 is suitably secured to the clamp segment 30*b* and to the upper end portion of the cylinder body 28. A longitudinal mounting lug 24 is suitably secured to the piston 46 of the cylinder 28.

The follower means D includes a flat support plate 102 having a hinge block 104 welded or otherwise suitably secured to the upper end portion thereof. A generally U-shaped spring-retaining bracket 106 is welded or otherwise suitably secured to the plate 102 and has pins 108 extending outwardly from the legs thereof. A generally flat paddle 110 has formed and spaced apart opposite legs 112 extending generally perpendicular thereto and to the guide surface 12 at the rear end of the paddle 110. The hinge block 104 and the paddle legs 112 have suitable aligned holes therethrough for receiving a hinge pin 116 which is suitably retained in the holes therethrough as by C-rings or the like. This provides hinged swinging movement of the paddle 110 from the stack clearing position of FIG. 7 to the ready and stack engaging position of FIG. 1. Spring holding pins 120 suitably secured to the paddle legs 112 and extend outwardly therefrom for receiving one end of coiled tension springs 122 which are also connected to the pins 108 on the bracket 106. The springs 122 normally bias the paddle 110 clockwise in FIG. 7 about the pin 116 until the rear end 124 of the paddle 110 engages a stop 126 on the hinge block 104. In that position, the paddle 110 extends generally parallel to the sheets 18 in the stack C or C1.

It will be recognized that the follower means is a unitary assembly including the paddle 110, the hinge block 104, the plate 102, the springs 122, the bracket 106 and the hinge pin 116. This assembly is suitably bolted or otherwise secured to the mounting lug 24. When bolts are used as in the arrangement shown, a suitable enlarged hole may be formed in the paddle 110 of a diameter substantially larger than the largest dimension of a bolt head used to secure the plate 102 to the lug 24 and with such enlarged hole being aligned with such bolt head in the stack clearing position of the paddle.

Although the view of FIGS. 7–9 have been shown with the components positioned vertically, it will be recognized that this has been done only for simplicity of illustration and that the components in the assembled apparatus are actually inclined to the right from the vertical as explained with reference to FIGS. 1–4. In general, the vertical components of FIGS. 7–9 are inclined so as to extend generally parallel to the guide surface 12 of FIGS. 1–4.

FIG. 7 shows the paddle 110 of the follower means D in its stack-clearing position engaging the rear face of a new stack C1 being formed as the follower means D is moving upwardly. The shadow line position of the paddle 110 shows its stack-engaging position in which it extends generally perpendicular to the guide surface 112 and generally parallel to the sheets 18 in the stack C1. When the paddle 110 is in its solid line stack clearing position of FIG. 7, it automatically moves back to the stack-engaging or ready position thereof upon reaching the top end of the stack being formed. It will be recognized that the paddle 110 reaches the top end portion of a new stack being formed substantially before the stack has been fully formed and this is due to the rapid movement of the follower means D under action of the rapid acting linear actuator means E.

The tension springs 122 define yieldable biasing means for normally biasing the paddle 110 to the stack-engaging position in a clockwise direction about the hinge pin 116. The yieldable biasing means defined by the tension spring 122 is automatically yieldable upon engaging the bottom or leading end of a stack for swinging same downwardly generally parallel to the rear face of the stack to the stack-clearing position thereof during upward movement of the follower means D until the free end of the paddle 110 clears the upper end of a new stack being formed whereupon the biasing means 122 automatically moves the paddle 110 back to its stack engaging and ready position.

In the arrangement shown and described, it will be recognized that the follower means D is automatically shiftable between stack-engaging and stack-clearing positions in accordance with the direction of linear movement thereof. When the follower means D is moving linearly upward, the paddle 110 engages a new stack being formed for shiftably swinging same downwardly to a stack-clearing position. Upon clearing the upper end of a new stack being formed, the follower means D in the form of the paddle 110 automatically moves back outwardly to its stack-engaging and ready position. The follower means D and its paddle 110 are also positioned for engaging a stack of sheets closely adjacent the rear face thereof where separation is likely to occur. That is, the paddle 110 is located closely adjacent the guide surface 112 for engaging the stack C closely adjacent the rear face thereof which engages the guide surface 112. The paddle 110 occupies a substantially flat area on the trailing end of the stack C which is substantially smaller than the total area of the trailing end of the stack. The paddle 110 is also located substantially centrally between the opposite sides of the stack.

In the preferred arrangement of the present application, the stacking apparatus forms a stack having a bottom leading end, an upper trailing end, and front and rear faces along which edges of stacked sheets are exposed. The stacking apparatus includes guide means inclined to the vertical for engaging and guiding the rear face of the stack during downward movement thereof as defined by the guide surface 12. The stacking means defined by the apparatus A and the support forks 14 is operative to lower the stack along the guide means 12 to a stack transfer position on the transfer forks 22. During downward movement of the stack, the rear face thereof drags along the guide means 12 and this tends to lift the sheets 18 adjacent the stack trailing end from the main body of the stack so that registration is lost between the lifted sheets and the remainder of the sheets in the stack. Movable follower means D engages the trailing end the stack at least adjacent the rear face thereof adjacent the guide means 12 during lowering movement of the stack to prevent such lifting of the sheets adjacent the trailing end of the stack and to thereby prevent loss of sheet registration.

What is claimed is:

1. Apparatus comprising stacking means for stacking sheetlike articles into a stack and moving such stack to a stack transfer position during which an edge of the articles in the stack drags along a guide surface and causes separation of articles from the stack at the trailing end thereof, follower means for engaging the trailing end of the stack and preventing separation of articles therefrom during movement of the stack to the stack transfer position, means for moving said follower means into engagement with the trailing end of the stack after the stack has been formed and for moving said follower means in one direction with the stack to the stack transfer position and in an opposite direction to a ready position for cooperation with a new stack being formed, and means for continuously maintaining said follower means in a stack engaging position while said follower means moves in the one direction and for shifting said follower means to a stack-clearing position while said follower means moves in the opposite direction.

2. Apparatus as set forth in claim 1 wherein said follower mean is positioned for engaging the trailing end of the stack closely adjacent the sheet edges which drag across the guide surface.

3. Apparatus as set forth in claim 1 wherein said follower means is pivotally shiftable between said stack-engaging and stack-clearing positions.

4. Apparatus as set forth in claim 1 wherein said follower means comprises a generally flat paddle.

5. Apparatus as set forth in claim 1 wherein said generally flat paddle extends generally perpendicular to the direction of stack movement in said stack-engaging position thereof and extends generally parallel to the direction of stack movement in said stack-clearing position thereof.

6. Apparatus as set forth in claim 5 wherein said means for continuously maintaining said follower means in a stack-engaging position and for shifting said follower means to a stack-clearing position comprises hinging means that swings between said stack-engaging and stack-clearing positions, and yieldable biasing means for normally biasing said follower means to said stack-engaging position.

7. Apparatus as set forth in claim 6 wherein said follower means while moving in said other direction is shifted to said stack-clearing position thereof by engaging an edge of a new stack to swing said follower means to said stack-clearing position against the force of said yieldable biasing means, whereby said follower means upon clearing the trailing end of a new stack is automatically moved to said stack-engaging position under influence of said yeildable biasing means.

8. Apparatus as set forth in claim 1 wherein means for moving said follower means comprises fluid cylinder means.

9. Apparatus as set for in claim 1 wherein said means for moving said follower means is a linear actuator means, and said apparatus further includes automatic control means for operating said linear actuator means.

10. Apparatus comprising stacking means for stacking sheet-like articles into a stack having a bottom leading end, an upper trailing end and front and rear faces along which edges of the articles are exposed, said stacking means including guide means inclined to the vertical for engaging and guiding said rear face of the stack during downward movement thereof, said stacking means being operative to lower the stack therealong to a stack transfer position and during which the rear face of the stack drags along said guide surface and tends to lift the articles adjacent the stack trailing end and rear face from the remainder of the stack, movable follower means for engaging the trailing end of the formed stack at least adjacent the rear face thereof during lowering movement of the stack to said stack transfer position, and means for moving said movable follower means into engagement with the trailing end of the stack and for moving said movable follower means downwardly with the stack to the stack transfer position.

11. Apparatus as set forth in claim 10 wherein said follower means is shiftable between stack-engaging and stack-clearing positions.

12. Apparatus as set forth in claim 11 wherein said means for moving said follower means moves downwardly with the stack to said stack transfer position moves said follower means upwardly to a ready position for cooperating with a new stack being formed, and said follower means being automatically shiftable to said stack-clearing position during upward movement thereof and being automatically movable to said stack-engaging position at least as soon as reaching said ready position.

13. Apparatus as set forth in claim 12 wherein said follower means is hinged for upward and downward swinging movement between said stack engaging and stack clearing positions, and yieldable biasing means is provided for normally biasing said follower means to said stack engaging position, said follower means being swingable to said stack clearing position by engagement thereof with the rear face of a new stack being formed.

14. Apparatus as set forth in claim 10 wherein said follower means comprises a generally flat paddle.

15. Apparatus as set forth in claim 10 including linear actuator means for moving said follower means downwardly with the stack and upwardly to a ready position.

16. Apparatus as set forth in claim 10 wherein said follower means is movable between a stack engaging position in which it extends generally parallel to the trailing end of the stack and a stack clearing position in which it extends generally parallel to the rear face of the stack.

* * * * *